US006150642A

United States Patent [19]

Weiss et al.

[11] Patent Number: 6,150,642

[45] Date of Patent: Nov. 21, 2000

[54] SEAT HEATER AND PROCESS FOR HEATING OF A SEAT

[75] Inventors: Michael Weiss, Benediktbeuren; Markus Hugenschmidt, Munich; Ralf Carle, Königsbrunn, all of Germany

[73] Assignee: W.E.T Automotive System AG, Odelzhausen, Germany

[21] Appl. No.: 09/352,208

[22] Filed: Jul. 13, 1999

[30] Foreign Application Priority Data

Jul. 14, 1998 [DE] Germany ..... 198 31 574

[51] Int. Cl.[7] ..... H05B 3/34

[52] U.S. Cl. ..... 219/528; 219/217; 219/549

[58] Field of Search ..... 219/211, 212, 219/217, 527, 528, 529, 545, 549; 338/208

[56] References Cited

U.S. PATENT DOCUMENTS

| | | | |
|---|---|---|---|
| 2,698,893 | 1/1955 | Ballard | 219/217 |
| 3,558,858 | 1/1971 | Luger, Jr. | 219/528 |
| 4,162,393 | 7/1979 | Balboni | 219/217 |
| 4,633,061 | 12/1986 | Arikawa | 219/217 |
| 4,695,091 | 9/1987 | Altmann et al. | 219/528 |
| 4,798,936 | 1/1989 | Johnson, Sr. | 219/217 |
| 4,825,048 | 4/1989 | Altmann et al. | 219/528 |
| 4,952,776 | 8/1990 | Huguet | 219/217 |
| 5,138,138 | 8/1992 | Theilacker et al. | 219/528 |
| 5,928,548 | 7/1999 | Johansson | 219/528 |

FOREIGN PATENT DOCUMENTS

| | | |
|---|---|---|
| 1912667 | 9/1970 | Germany . |
| 4101290 | 7/1992 | Germany . |
| 29612037 | 12/1996 | Germany . |
| 613655 | 12/1948 | United Kingdom . |

*Primary Examiner*—Teresa Walberg
*Assistant Examiner*—Fadi H. Dahbour
*Attorney, Agent, or Firm*—Rothwell, Figg, Ernst & Manbeck

[57] ABSTRACT

The seat heater includes at least one electric sheet-type heating element (10) made of flexible high-resistivity material to which the main electrodes (13A, 13B) are connected. In order to minimize the time during which the seat is perceived as being cold without any notable increase in overall power requirements, the seat heater is equipped with an additional feature (18A, 18B) for heating basically at least a partial area (SH) of the sheet-type heating element (10) with increased heating density, and a switch device for changing from heating the partial area (SH) with the additional feature (18A, 18B) to overall homogeneous heating of the sheet-type heating element (10) with regular heating density through the main electrodes (13A, 13) or the main electrodes (13A, 13B) and the additional feature (18A, 18B).

6 Claims, 3 Drawing Sheets

SEAT HEATER AND PROCESS FOR HEATING OF A SEAT

BACKGROUND OF THE INVENTION

1. Field of Invention

The invention concerns a seat heater with an electric conductive sheet-type heating element made of flexible high-resistivity material to which the main electrodes for heating the sheet-type heating element are connected.

2. Description of the Background Art

An overall high level has been achieved in the design of seat heaters. Several technologies are available that ensure even warming of the seat. For example, the strand technology has been employed very successfully since heat output can be set within a wide range with this design. Additionally, the heat output can be adjusted to the seat's geometry. Due to the complex production procedure, however, this technology is increasingly limited to special applications.

Recently, a textile sheet-type heating element on carbon basis has been employed as the conductive sheet-type heating element for seat heaters; apart from the benefit of increased mechanical comfort, this technology also guarantees very homogeneous distribution of thermal output due to its design.

With the help of these known seat heaters, it is possible to warm seats very homogeneously so that a comfortable heat temperature is achieved after a heating phase and no differences in temperature arise that could be felt on the seat. With the seat's thermal capacity being a given value, these known seat heaters unfortunately do not allow this condition to be achieved quickly due to limitations of the heater's overall power requirements. The seat's thermal connection with the passenger additionally creates the basic problem of the passenger contributing to the warming process of the cold seat in the initial phase to a relatively large extent and thus reinforcing the perception of coldness. In this respect, existing seat heaters do not keep the passenger completely away from unpleasant influences and are therefore insufficient. Furthermore, we can proceed on the assumption that during the time that the driver perceives his seat as being cold a reduction in his ability to concentrate occurs. The problem of the delayed warming process can certainly be described as the largest weakness of existing seat heaters since the need for a seat heater is directly connected to the fact that the seat should warm up faster, from heat made available by the motor, compared to the much slower warming of the vehicle's interior.

SUMMARY OF THE INVENTION

The invention is based on the object of creating a seat heater as well as a process for heating a seat with simple design means, which make it possible to minimize the time that the seat is perceived as being cold without any notable increase in overall power requirements.

On the invented seat heater, the special feature for heating a partial area of the sheet-type heating element with increased heating density forms a 'quick-heating field,' which leads to a concentration of thermal output to a small area of the entire seat's surface and thus to considerably faster warming in that area. The passenger therefore will feel the warming process much more quickly, e.g. within the first minute after turning on the heater. The lower thermal output of the surrounding seat areas is not perceived as being disruptive.

After the quick-heating field has shown its effect, the seat heater is operated all over so that very homogeneous heating is achieved, as is the case with known systems, for example. Selection of the quick-heating field's geometry can be adjusted to the seat's geometry and can also be optimized ergonomically. The quick-heating field can also be used for homogeneous heating all over.

Despite its excellent functionality, the invented seat heater can be produced economically from machine-made piece goods, such as carbon-based fabrics. The additional work that is required for structuring the design in order to be able to attach at least one additional electrode and a control unit is within acceptable means compared to the benefit that is achieved, i.e. the considerably shorter heating time.

An existing sheet-type heating element can be modified in various ways with two electrodes in such a way that it reaches the functionality of a seat heater with a quick-heating field. Initially, at least one additional electrode must be attached to the sheet-type heating element in order to enable intermittent concentration of heating output. The geometrical configuration of this at least one additional electrode determines the size and heating density of the partial surface which serves as the quick-heating field. In a preferred version, thermal output density in this quick-heating field can also be adjusted with the electric potential that is selected to run through this at least one electrode.

To obtain increased spatial limitation of the quick heater's thermal output, the sheet-type heating element can be divided into sectors by generating a line-shaped electric separation within the surface. Contrary to the familiar structuring of sheet-type heating elements with line-shaped separation, which serve the purpose of being able to adjust to randomly shaped surfaces (e.g. through mechanical separation), electric sectoring has the objective of obtaining the largest possible configuration space when dividing thermal output density between the quick-heating field and the remaining heating field.

With the invented seat heater, the invented process for heating a seat area, particularly a vehicle seat, can be performed by initially heating a partial area of the seating surface with increased heating density, and then switching to overall and homogeneous heating of the seating surface with regular heating density once certain conditions have been achieved. The conditions could be, e.g. a pre-determined temperature, a pre-determined time, the range of a characteristic line of certain operating and/or surrounding parameters, etc.

In the invented seat heater, the problem of spatial concentration of thermal output is resolved in a simple and elegant way, i.e. there are few additional design features on the sheet-type heating element, and the entire system can be controlled with a simple control unit.

Overall output can be maintained at a constant over time with an electronic control unit, which triggers the individual electrodes in accordance with external standard variables and/or internal programs/characteristic lines or properties.

BRIEF DESCRIPTION OF THE DRAWINGS

The following explains versions of the invention in greater detail with the help of drawings.

They show.

DETAILED DESCRIPTION OF THE DRAWINGS

The seat heaters shown in FIG. 1 through 6 serve to heat of the back and/or sitting cushion of a motor vehicle seat.

Figure 1:
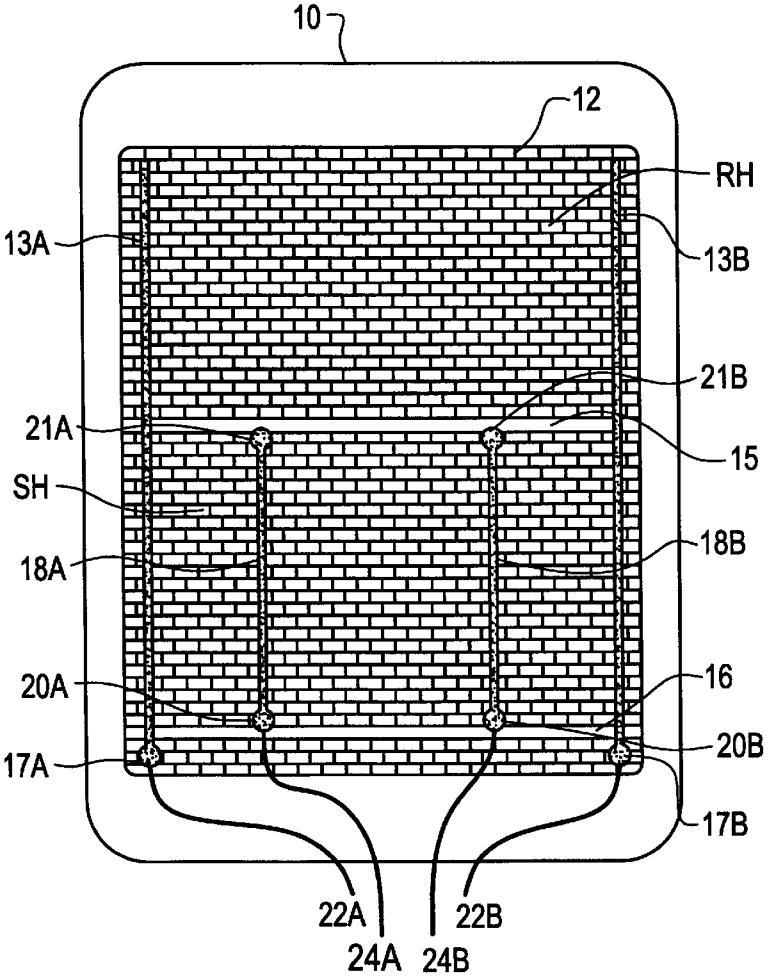
FIG. 1 a seat heater with a sectored sheet-type heating element with two main and two additional electrodes, FIG. 2 a seat heater with a continuous sheet-type heating element with two main and two additional electrodes, FIG. 3 a seat heater with a sectored sheet-type heating element with two main and one additional electrode, FIG. 4 a seat heater with a continuous sheet-type heating element with two main and one additional electrode, FIG. 5 a seat heater with a sectored sheet-type heating element with electrodes that are woven in, FIG. 6 a seat heater with a continuous sheet-type heating element with one additional heating element with strand technology.

The seat heater 10 shown in FIG. 1 is equipped with a rectangular sheet-type heating element 12 made of woven carbon fiber filaments. Adjacent to the two opposite longitudinal edges of the sheet-type heating element 12, one main electrode each 13A and 13B is arranged in such a way that it stretches parallel to the respective longitudinal edge across the entire length of the sheet-type heating element 12.

A groove 15 that stretches vertically to the main electrodes 13A, 13B is located between the two main electrodes 13A, 13B in the center of the sheet-type heating element 12 and electrically separates the area of the sheet-type heating element 12 that is adjacent on the top between the main electrodes 13A, 13B, as shown in FIG. 1, from the adjacent area on the bottom. Another similar groove 16 is provided for near the bottom edge of the sheet-type heating element 12 parallel to the groove 15 in such a way that it stretches between the main electrodes 13A, 13B.

Two additional electrodes 18A, 18B that run parallel to the main electrodes 13A, 13B are arranged between the two grooves 15, 16 on the sheet-type heating element 12. The contact points 17A, 17B of the main electrodes 13A, 13B on the sheet-type heating element 12 are located beneath the lower groove 16.

The contact points 20A, 20B or 21A, 21B of the additional electrodes 19*a,* 19*b* are located in an immediately adjacent position to the groove 15 or 16.

The lines to the main electrodes 13A, 13B are marked 22A and 22B, while the lines to the additional electrodes 18A, 18B are designated as 24A and 24B.

The grooves 15, 16 create two electrically separated heating fields. During heating operation in the 'all-over' mode, electric potential runs only through 22A and 22B, while during quick-heating operation potential runs only through 24A and 24B, i.e. on the additional electrodes 18A, 18B. The after case basically corresponds to the parallel connection of two heating fields, the quick-heating field SH and the remaining heating field RH, however with thermal output density in the remaining heating field RH being drastically reduced.

Figure 2:
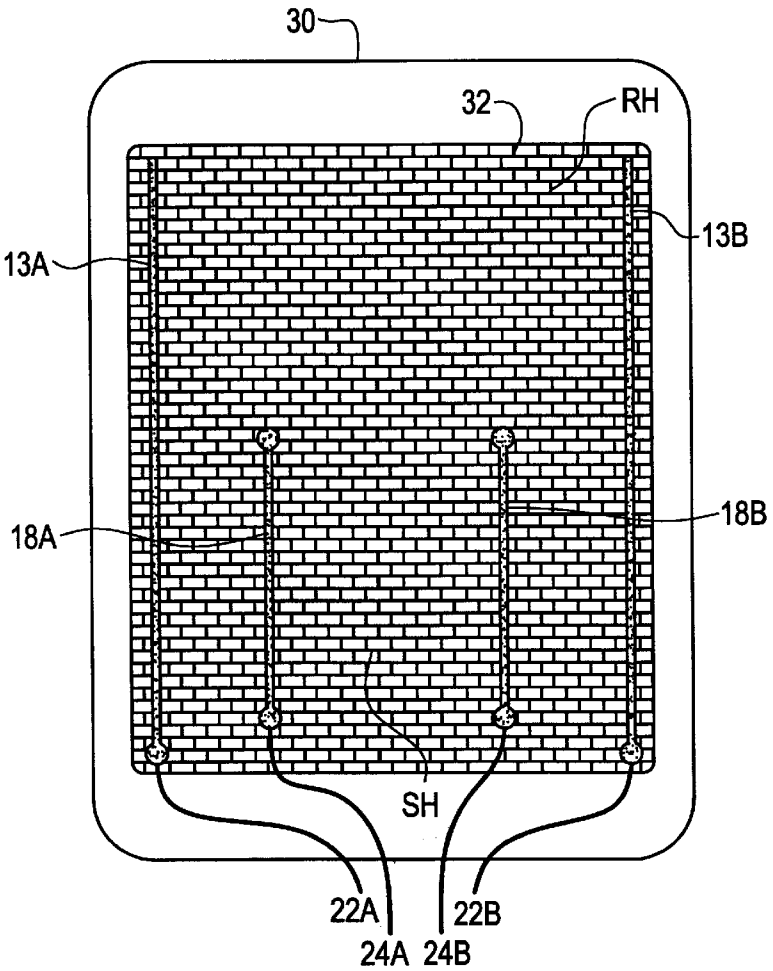

The seat heater 20 shown in FIG. 2 only differs from the seat heaters 10 depicted in FIG. 1 in that no grooves 15, 16 are provided for in its sheet-type heating element 32. The heating fields RH and SH are therefore coupled more strongly so that the thermal output gradients that can be achieved are generally lower than is the case with the seat heater 10 in FIG. 1.

Figure 3:
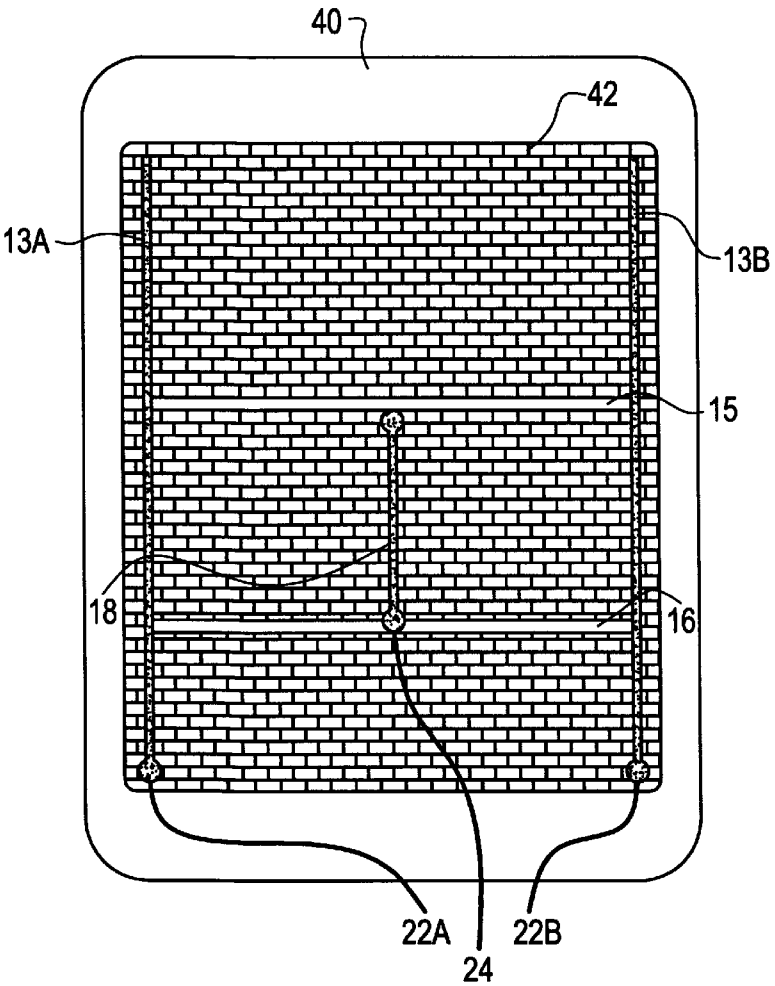

The seat heater 40 shown in FIG. 3 differs from the seat heater 10 depicted in FIG. 1 in that only one additional electrode 18 with a connecting line 24 is provided for in its sheet-type heating element 42. This can be beneficial for operational reasons.

Figure 4:
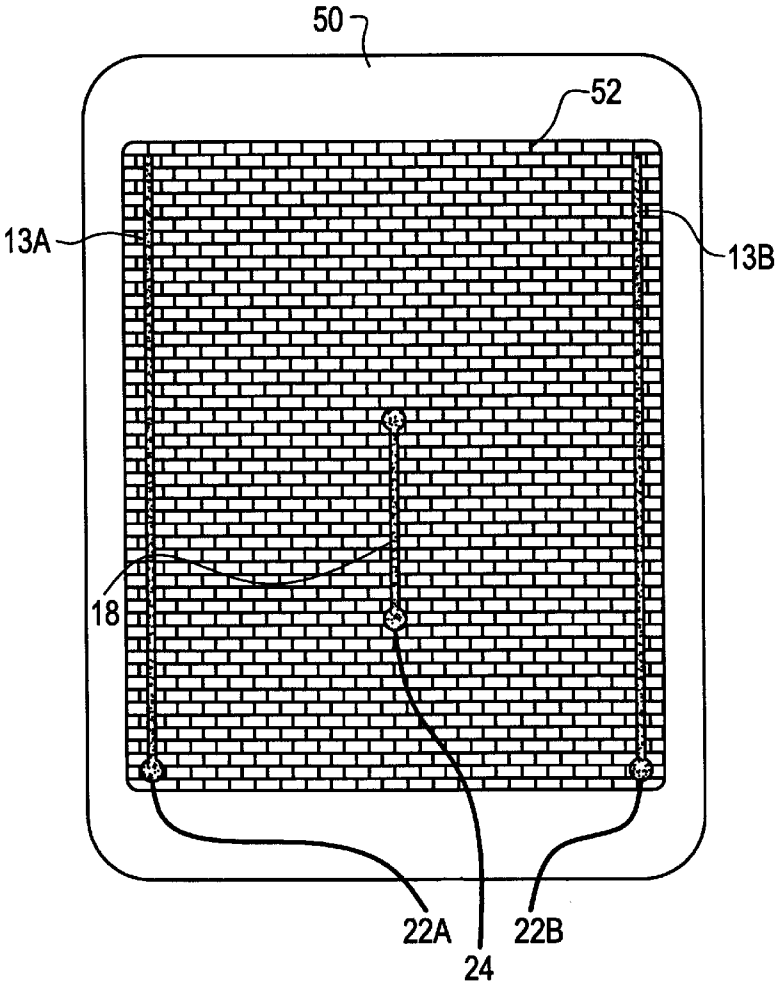

The seat heater 50 shown in FIG. 4 differs from the seat heater 40 depicted in FIG. 4 in that no grooves 15, 16 are provided for in its sheet-type heating element 52.

During quick-heating operation of the seat heater shown in FIG. 3, 22A and 22B, for example, have the same potential; heating potential, however, drops compared to 24. This means that overall thermal output is restricted homogeneously to the area limited by the grooves 15, 16 and the main electrodes 13A, 13B.

Figure 5:
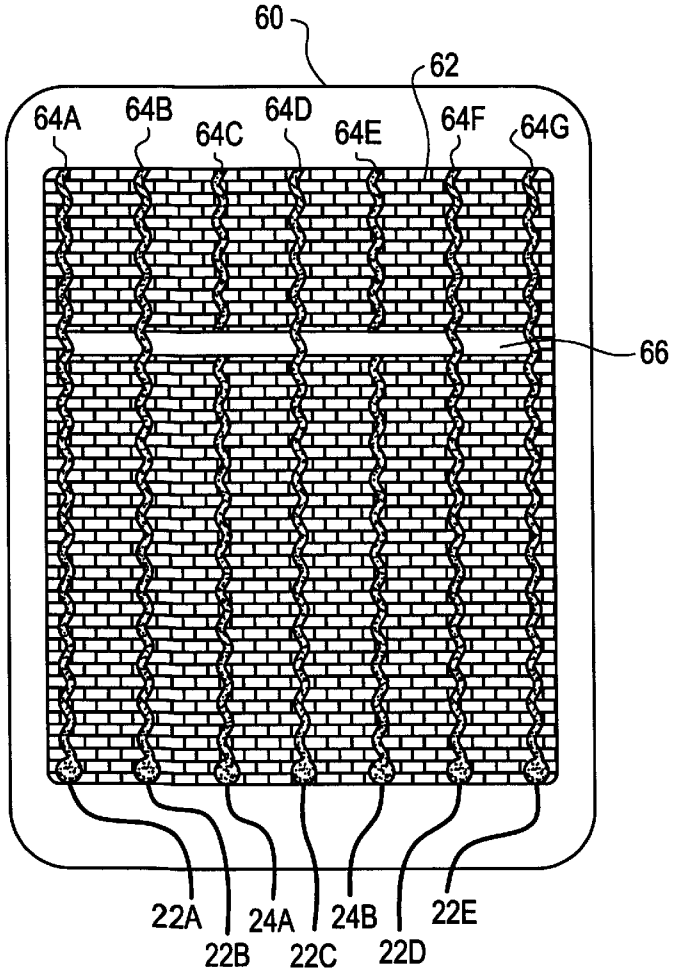

FIG. 5 depicts a seat heater 60 with a multi-electrode sheet-type heating element 62. It is a pre-engineered sheet-type heating element 62, into which several electrodes 64A through 64G are woven in the sheet-type heating element's 62 longitudinal direction, parallel to and at a distance from each other. A groove 66 that runs transversely to the electrodes is provided for in the sheet-type heating element 62 between the two outer electrodes 64A and 64G for electric separation. Additionally, the electrodes 64C and 64E are separated in the area of the groove 66 for the purpose of forming additional electrodes. Due to electric separation of the sheet-type heating element 62 based on the groove 66 and separation of the electrodes 64C and 64E, the seat heater 60 can be operated in such a way that spatial concentration of thermal output is created.

Figure 6:
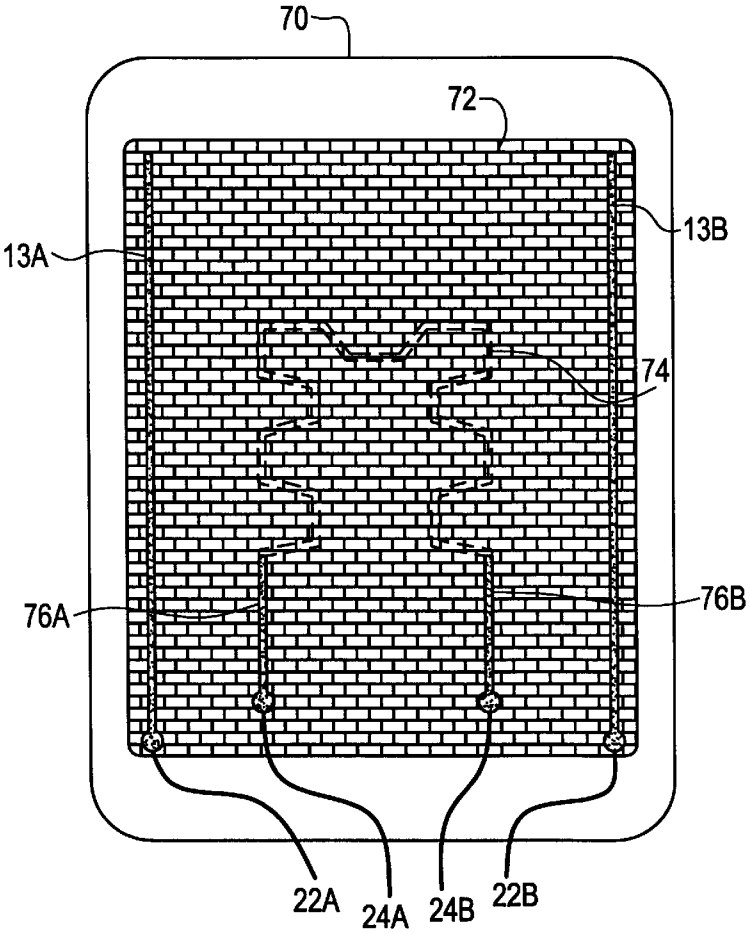

The seat heater 70 shown in FIG. 6 is equipped with a sheet-type heating element 72 made of woven carbon fiber filament, on whose opposite longitudinal sides one main electrode 18A, 18B, respectively, is arranged. A quick-heating element 74 is attached in the center of the sheet-type heating element 72 with conventional strand technology, which affects a small area of the entire surface. The quick-heating element 74 is connected via two additional electrodes 76A and 76B. A very simple strand running layout can be used in which one electrically insulated heating area runs directly on the sheet-type heating element 72. This way, strong integration of the two sheet-type heating elements 72, 74 as well as a simple design can be achieved. In this case, activation of the quick-heating field 74 via the additional electrodes 76A, 76B occurs independently of the 'all-over' heating mode with the main electrodes 13A, 13B.

When expanding a seat heater with a quick-heating field, special activation features are required. Since a heating system's standard requirement is the limitation of overall power requirement and at the same time the heating process should occur as quickly as possible, it is necessary to redesign the activation of the heating process in general.

For certain designs of heating areas, it is sufficient to utilize only e.g. a temperature sensor (for example, NTC sensors that are currently being used) if this sensor is placed within the quick-heating field and if the area of the quick-heating field is also heated regularly, i.e. with the same thermal output density, during heating in the 'all-over' setting.

Activation of two or more heating areas can basically occur with a simple switch, which allows changes between spatially limited quick-heating and sheet-type heating.

It would also be feasible, however, to use a control unit that would meet these requirements entirely, but would perform this switching process automatically and that could guarantee a transition from quick-heating to sheet-type heating on a continuous basis, i.e. by utilizing the entire system's thermal inertia, for example by pulse width triggering many switching processes.

This control unit consists of an interface to external sensors and to an On/Off switch or operating element, internal logic/characteristic lines or properties and a power switch that can distribute overall power output via the various electrodes to the different heating areas in accordance with the control unit. Pulse width triggering of the switch processes occurs, for example, in such a way that a pulse of the maximum length $t_1$ is generated within a time frame $t_1$ of just a matter of seconds. During this pulse length, the quick-heating field is heated, while during the remaining time of the time frame $t_1$ the 'all-over' mode is activated. Triggering will display only a characteristic line or property or the like, so that directly upon turning on the seat heater the pulse duration initially covers the entire time frame for a certain amount of time. Once the quick-heating field has reached the desired temperature (or followed another criterion or algorithm), pulse duration is then reduced gradually to a minimum value in order to change to the all-over heating mode, or the like.

What is claimed is:

1. Seat heater with at least one electric sheet-type heating element (10) made of flexible high-resistivity material, the heating element having opposite sides to which main electrodes (13A, 13B) are directly connected for the purpose of heating the sheet-type heating element (10), characterized by an additional feature (18A, 18B) for heating basically at least a partial area (SH) o f the sheet-type heating element (10) with increased heating density, and a switching device for changing from heating the partial area (SH) with the additional feature (18A, 18B) to a basically all-over homogeneous heating process of the sheet-type heating element (10) with regular heating density through the main electrodes (13A, 13B), or through the main electrodes (13A, 13B) and the additional feature (18A, 18B).

2. Seat heater according to claim 1, characterized by the fact that the additional feature for heating the partial area (SH) of the sheet-type heating element (10) with increased heating density comprises at least one additional electrode (18A, 18B), which is connected to the sheet-type heating element (10) in the partial area (SH).

3. Seat heater according to claim 1, characterized by the fact that the partial area (SH) is electrically separated in part from the remaining area (RH) of the sheet-type heating element (10).

4. Seat heater according to claim 2, characterized by the fact that the sheet-type heating element (50) is a textile and that the main electrodes (64A, 64B, 64D, 64F, 64G) and the additional electrodes (64C, 64E) are integrated into the textile.

5. Seat heater according to claim 1, characterized by the fact that the additional feature for heating the partial area of the sheet-type heating element (72) with increased thermal density comprises at least one quick-heating element (74) that is produced with strand technology and is connected to the partial area.

6. Seat heater according to claims 1, characterized by the fact that the high-resistivity material is made of carbon.

* * * * *